United States Patent [19]

Saito et al.

[11] Patent Number: 4,963,320

[45] Date of Patent: Oct. 16, 1990

[54] METHOD AND APPARATUS FOR PRODUCING ANISOTROPIC RARE EARTH MAGNET

[75] Inventors: Makoto Saito, Nagoya; Teruo Watanabe, Aichi; Shinichiro Yahagi, Ohbu; Yasuaki Kasai; Norio Yoshikawa, both of Nagoya; Yutaka Yoshida; Toshiya Kinami, both of Tokai; Hiyoshi Yamada, Iwakura, all of Japan

[73] Assignee: Daido Tokushuko Kabushiki Kaisha, Aichi, Japan

[21] Appl. No.: 507,438

[22] Filed: Apr. 11, 1990

[30] Foreign Application Priority Data

Apr. 14, 1989 [JP] Japan ..... 1-95600
Jul. 31, 1989 [JP] Japan ..... 1-198172

[51] Int. Cl.[5] ..... C22C 32/00

[52] U.S. Cl. ..... 419/12; 75/244; 419/24; 419/39; 419/41; 419/54; 419/55; 419/67; 419/60; 148/101; 148/302; 420/83

[58] Field of Search ..... 75/244, 251; 419/24, 419/67, 39, 41, 60, 54, 55, 12; 148/101, 302; 420/83

[56] References Cited

U.S. PATENT DOCUMENTS

| | | | |
|---|---|---|---|
| 4,604,042 | 9/1986 | Tanigawa et al. | 425/3 |
| 4,826,546 | 5/1989 | Yamamoto et al. | 148/102 |
| 4,873,504 | 10/1989 | Blume, Jr. et al. | 335/303 |
| 4,892,506 | 1/1990 | Chatterjee | 148/104 |
| 4,919,858 | 4/1990 | Newton et al. | 264/24 |
| 4,921,553 | 5/1990 | Tokunga et al. | 148/302 |

*Primary Examiner*—Stephen J. Lechert, Jr.
*Assistant Examiner*—Nina Bhat
*Attorney, Agent, or Firm*—Sughrue, Mion, Zinn, Macpeak & Seas

[57] ABSTRACT

A method for producing an anisotropic rare earth magnet is improved by applying compressing stress on a free surface of an compacted material at the time of extruding the compacted material in order to prevent forming cracks, and improved by using a double action punch provided with a core punch and a sleeve punch so as to mold a compacted material and extrude the compacted material into the anisotropic magnet material in a single heat process continuously.

20 Claims, 13 Drawing Sheets

METHOD AND APPARATUS FOR PRODUCING ANISOTROPIC RARE EARTH MAGNET

BACKGROUND OF THE INVENTION

1. Field of the Invention

This invention relates to a method and an apparatus for producing an anisotropic rare earth magnet, and in particular to a method and an apparatus for producing an anisotropic rare earth magnet of R-Fe-B system (R and Fe are shown on behalf of rare earth metals of lanthanum series and transition metals including iron respectively, B is shown on behalf of other additional metals including boron to improve the properties) represented by a magnet of Nd-Fe-B system.

2. Description of the Prior Art

The magnet of R-Fe-B system is provided in two types as mentioned hereunder;

(a) a sintered magnet which is made into an anisotropic magnet through a process of casting the molton base alloy into an ingot, pulverizing the ingot into fine powder, molding the powder into a green compact by pressing in a magnetic field using a metal mold, and sintering the green compact, and (b) a super-quenched magnet which is made by using a super-quenched magnet material 57 given with a magnet anisotropy through a process of making a thin flake by cooling super-rapidly the molton base alloy, molding a compacted material 54 with magnetic isotropy by hot pressing at a temperature of about 700° C. (for example, the compacting pressure is 1 ton/cm$^2$) with a die 52 and an upper punch 53 shown in FIG. 12(*b*) using the coarse grained powder of said thin flake of the base alloy directly or, as shown in FIG. 12(*a*), using a green compact 51 having a theoretical density ratio of about 80% molded by cold-pressing the powder of said base alloy (for example, the compacting pressure is 4 ton/cm$^2$), and performing plastic working of a reduction ratio of area of not less than 40% on the compacted material 54 at a temperature of not higher than 900° C. using a different die 55 and upper punch 56 shown in FIG. 12(*c*) (for example, the extruding pressure is 4 ton/cm$^2$).

Applying these magnets having excellent magnetic properties to especially small-sized electric motors used for various automatizing apparatus is very useful to make the motors lighter and smaller, nevertheless the fact is that said magnets are not applied to the motors sufficiently at the present time because of technical problems in the practical application.

In order to apply the aforementioned rare earth magnet to said motors, it is desirable to make the magnet into a thin sleeve or ring-shaped magnet given with magnetic anisotropy in the radial direction. However, in the aforementioned sintered magnet, it is difficult to give a magnet field in the radial direction at the time of forming the powder in a magnetic field, therefore, there is a problem since the anisotropic degree becomes low down to about 50~60% of the case of a plate-shaped magnet. And there is another problem in that the sintered magnet is easy to crack owing to anisotropy of the thermal expansion caused by heating and cooling at the time of sintering.

In the super-quenched magnet, it is possible to give the magnetic anisotropy to the utmost limit in even case of said sleeve or ring-shaped magnet because the magnetic anisotropy is given by the plastic deformation without forming in the magnetic field. However, there is a problem in that the heating processes of two cycles are required, that are the molding of the compacted material 54 having magnetic isotropy and theoretical density ratio of not lower than 99% by the die 52 and the upper punch 53 shown in FIG. 12(*b*), and the forming to give the magnetic anisotropy by the plastic deformation using the die 55 and the upper punch 56 shown in FIG. 12(*c*). And the magnetic property of this material is affected sensitively by the grain size, therefore there is another problem since the magnetic property deteriorates by the growing of the grain size caused by heating for a long time. In addition to above said magnetic material is quite brittle, therefore forming cracks 58 as shown in FIG. 12(*c*) are easy to appear in case of forming the compacted material 54 into the sleeve or the ring-shaped magnet material 57 by extruding.

SUMMARY OF THE INVENTION

This invention is made in view of the aforementioned problems of the prior art on the manufacturing technique of the anisotropic rare earth magnet of the super-quenched type having the ring-shaped section, and an object of the invention is to provide a method which is possible to produce on anisotropic rare earth magnet with an excellent magnetic property without occurrence of the forming cracks.

And another object of the invention is to provide a method which is possible to produce an anisotropic rare earth magnet having an excellent magnetic property by single heat process.

Further, another object is to provide an apparatus which is used for producing the anisotropic rare earth magnet by the above-mentioned methods according to this invention.

A method for producing an anisotropic rare earth magnet according to the first perferred aspect of this invention is characterized by extruding a compacted material with magnetic isotropy into a required form having a ring-shaped section at the same time of applying compressive stress on a free surface of said compacted material.

In this case, it is desirable to perform said extruding at a temperature between 650° C. and 900° C. in a vacuum of not more than 1 Torr or in an atomosphere of an inert gas.

Furthermore, said extruding may subsequently be carried out at a temperature between 650° C. and 900° C. in the air after forming an non-oxidizing film on the surface of said compacted materials.

A method for producing an anisotropic rare earth magnet according to the second preferred aspect of this invention is characterized by producing the anisotropic rare earth magnet having the ring-shaped section by a single heat process through the steps of making a thin flake by cooling super-rapidly molton rare earth magnet alloy, molding a green compact from the powder of said thin strip of rare earth magnet alloy by cold pressing, compressing uniformly the green compact heated at a temperature between 650° C. and 900° C. into a compacted material having theoretical density ratio of not lower than 99% using a double action punch provided with a core punch and a sleeve punch, and in successively extruding the compacted material into a required form having a ringshaped section by using the core punch subsequent to backing the sleeve punch of said double action punch.

In this case, said compacted material may be molded directly from the powder of said rare earth magnet alloy by compressing uniformly at a temperature between 650° C. and 900° C. using said double action punch without using the green compact molded by cold pressing.

And in the above-mentioned methods for producing the anisotropic rare earth magnet according to the second preferred aspect, the extruding may be carried ouy by the core punch at the state of applying predetermined compression stress on a free surface of said compacted material by the sleeve punch of said double action punch without backing said sleeve punch in order to prevent forming cracks.

Furthermore, the compressing and the extruding may be carried out in a vacuum of not more than 1 Torr or in an atomosphere of an inert gas in the methods described above.

And in the above-mentioned methods for producing the anisotropic rare earth magnet according to the second preferred aspect, said green compact may be molded from the powder mixed with a lubricant such as lithium stearate of not more than 2% in weight percentage in order to increase the green density of said green compact.

An apparatus for producing an anisotropic rare earth magnet according to this invention which is used for practising the method according to this invention is characterized by having a double action punch provided with a core punch and a sleeve punch.

DETAILED DESCRIPTION OF THE INVENTION

In the R-Fe-B magnet according to this invention, R denotes rare earth metals of lanthanum series represented by Nd, and said magnet contain small amount of substances for improving the magnetic property such as Co, $Dy_2O_3$, Ga or the like, and substances for improving the corrosion resistance, the thermal resistance and the workability such as Ni, Zn, Pb, Al or the like.

In the method for producing the anisotropic rare earth magnet according to the first preferred aspects of this invention, a solid or hollow compacted material with magnetic isotrory is formed into a sleeve-shaped or ring-shaped form having a ring-shaped section by extruding. Hereupon, said compacted material can be provided by compressing powder of a super-quenched thin flake of rare earth magnet alloy in a vacuum or an atomosphere of an inert gas. In this case, the solid or hollow compacted materual having a theoretical density ratio of not lower than 99% can be obtained.

As said extruding method, backward extruding and forward extruding are both applicable. In these extruding, said compacted material is made in contact with the surfaces of the molds such as a die, a punch and so on, and is deformed plastically while receiving restriction from them, but the compact material has a free surface out out contact with said molds in a part thereof. For example, a part of the end-face in the flowing direction of the material, that is a part of the end-face on the backside becomes into the free surface in the case of backward extruding. And a part of the end-face on the front side of the material becomes into the free surface in the case of forward extruding.

In this aspect, by applying compressive stress to said free surface using a prescribed pressure means, the compacted material is deformed plastically under such a pressurized condition. Therefore, it is necessary to use an apparatus possible to pressurize the free surface of the material at the same time of moving said free surface as a pressure means.

In such a manner, it is possible to prevent the forming cracks effectively and to obtain the anisotropic rare earth magnet having an excellent magnetic property and a ring-shaped section in the case of extruding the compacted material with the pressurization on the free surface of the material.

The method for producing the anisotropic rare earth magnet according to this aspect will be described below on basis of drawings.

Figures 2A, 2B:
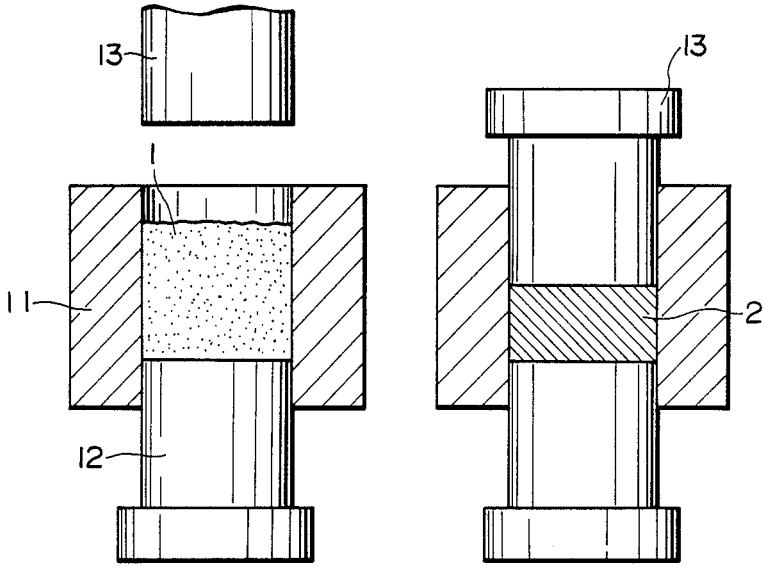
FIGS. 2(*a*) and 2(*b*) are sectional views illustrating the molding method of the cylindrical compacted material in order to perform said first aspect of this invention.
Figure 3A:
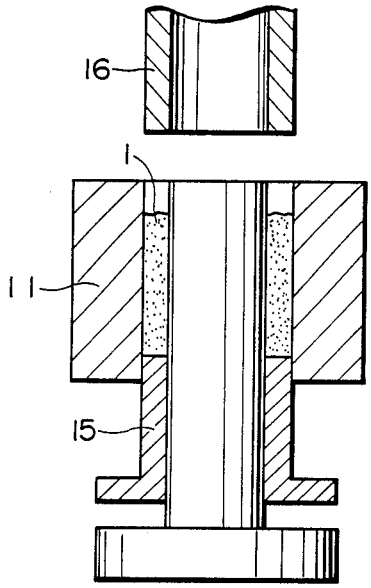
FIGS. 3(*a*) and 3(*b*) are sectional views illustrating the molding method of the hollow cylindrical compacted material in order to perform said first aspect of this invention.
Figure 3B:
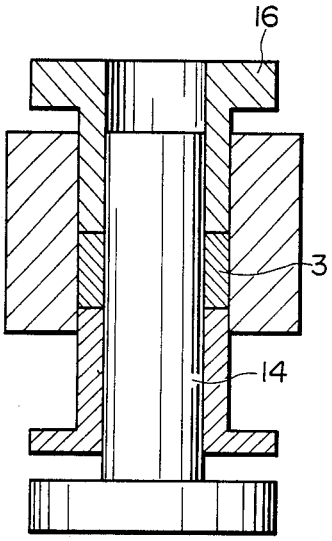

FIG. 2 and FIG. 3 show manners for obtaining the compacted materials with magnetic isotropy. Among them, FIG. 2 shows a manner for obtaining the solidly cylindrical compacted material, and FIG. 3 shows a manner for obtaining the hollow cylindrical compacted material.

In FIG. 2, numeral 11 is a die, numeral 12 is a lower punch (knock out punch) and numeral 13 is an upper punch.

In order to mold a cylindrically solid compacted material 15, first of all, powdered material 1 which is powder of the super-quenched thin flake of rare earth magnet alloy is filled into a molding cavity formed by the die 11 and the lower punch 12 as shown in FIG. 2(*a*). In this time, it is desirable to heat the mold previously at a temperature between 600° C. and 900° C., preferably between 700° C. and 800° C. by proper means. And it is advisable to house the apparatus entirely in a sealing chamber evacuated into a pressure of not more than 1 Torr or filled with an inert gas such as argon gas.

Said powdered material 1 is filled and kept in the mold for 1~3 minutes, and is heated by heat transmission from the mold. When the powdered material 1 attains a prescribed temperature, by forcing down the upper punch 13, the powdered material 1 is compressed as shown in FIG. 2(*b*). At this time, compression stress of 0.5~2 ton/cm$^2$, preferably 1~1.5 ton/cm$^2$ is applied on it. Thereby, a compacted material (cylindrical isotropic magnet material) 2 of which theoretical density ratio is not lower than 99% is obtained.

In order to obtain a hollow cylindrical compacted material 3, the powdered material 1 is filled into a molding cavity formed between the die 11 and a center core 14 as shown in FIG. 3(*a*), and is compressed by a hollow cylindrical lower punch 15 and an upper punch 16 as shown in FIG. 3(*a*). And subsequently, the hollow cylindrical compacted material 3 is taken out of the mold by elevating the lower punch 15.

Additionally, the powdered material 1 may be mixed with a lubricant such as lithium stearate of not more than 2%, thereby it is possible to plan to improve the lubrication between the mold and the material 1 at the time of molding.

Figure 1A:
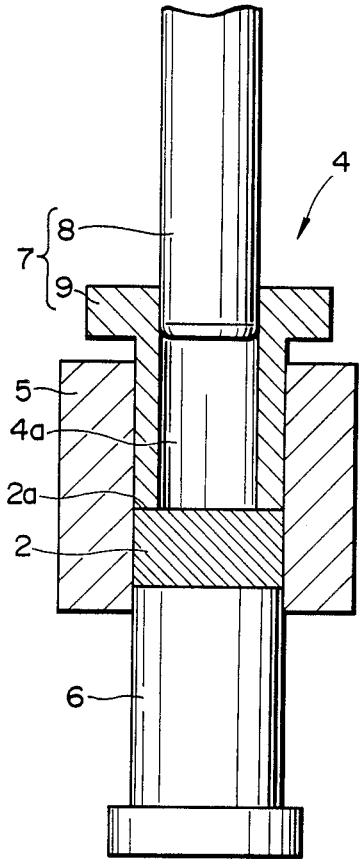
FIGS. 1(*a*) and 1(*b*) are sectional views illustrating the forming method of the anisotropic rare earth magnet material from the cylindrical compacted material by backward extruding in order to perform the method for producing the anisotropic rare earth magnet according to the first preferred aspect of this invention.
Figure 1B:
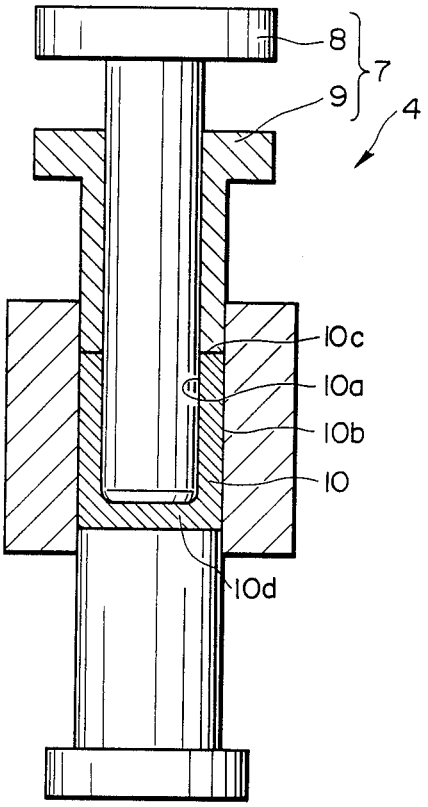

Nextly, explanation will be given on the procedure for forming the solid-cylindrical compacted material 2 obtained by the manner shown in FIG. 2 into the sleeve-like shape by backward extruding on basis of FIG. 1. First, the compacted material 2 is set in a molding cavity 4*a* of a mold 4 provided with a die 5, a lower punch 6, and a double action punch 7 having a core punch 8 and a sleeve punch 9 as shown in FIG. 1(*a*). In this case, it is desirable to heat the mold 4 previously at a temperature between 650° C. and 900° C., preferably between 700° C. and 850° C. by proper means. And it is advisable to house the apparatus wholly in a sealing chamber which is kept at a vacuum of pressure of not more than 1 Torr or filled with a inert gas such as argon gas in order to prevent the oxidization of the compacted material 2.

Said compacted material 2 may be set in the molding cavity 4*a* after heating it by proper heating means such as high-frequency heating, or may be heated in the molding cavity 4*a* by heat transmission form the mold 4.

After raising the temperature of the compacted material 2 at the predetermined temperature, compressive stress is applied on the upper face 2*a* of said compacted material 2 by forcing down the hollow cylindrical sleeve punch 9. The compressive stress of 0.2~1 ton/cm$^2$, preferably 0.4~0.6 ton/cm$^2$ is suitable to be given in this time. And it is suitable to use an oil hydraulic cylinder or a pneumatic cylinder as a means for forcing down the sleeve punch 9. By using these cylinders it is possible to move the sleeve punch 9 of the double action punch 7 up and down corresponding to the level of the upper face 2*a* of the compacted material 2. Namely, it is possible to deform the compacted material 2 plastically as the predetermined compressive stress is applied on the free surface of said compacted material 2.

Subsequently, by forcing down the core punch 8 as shown in FIG. 1(*b*), the compacted material 2 is formed into a sleeve-shaped anisotropic magnet material 10 by backward extruding. The extruding pressure should be 2~5 ton/cm$^2$, preferably 2.5~3.5 ton/cm$^2$ in this time.

In this manner, it is possible to prevent the forming cracks on the inner periphery 10*a* or the outer periphery 10*b* of the sleeve-shaped magnet material 10 by applying the predetermined stress on the upper face 2*a* (10*c*) of the compacted material 2 during the extruding as shown in FIG. 1(*b*).

By elevating the lower punch 6 after finishing the extruding, the sleeve-shaped anisotropic magnet material 10 is knocked out of the mold 4, and is cut off at the bottom part 10*d* thereof separately.

At this time, it is also possible to perform the aforementioned extruding in the air by coating the surface of said compacted material 2 in advance with an non-oxidizing film. As the non-oxidizing film, it is suitable to place with an antioxidative metal such as nickel and suitable to make airtight liquid such as water glass into the film by drying after applying it to the surface of the compacted material 2.

In this aspect, the forward extruding may be available in addition to said backward extruding, also in this case, it is possible to form the sleeve-shaped magnet material 10 without occurence of the forming cracks. The forming according to the forward extruding will be explained below on basis of FIG. 4.

Figure 4A:
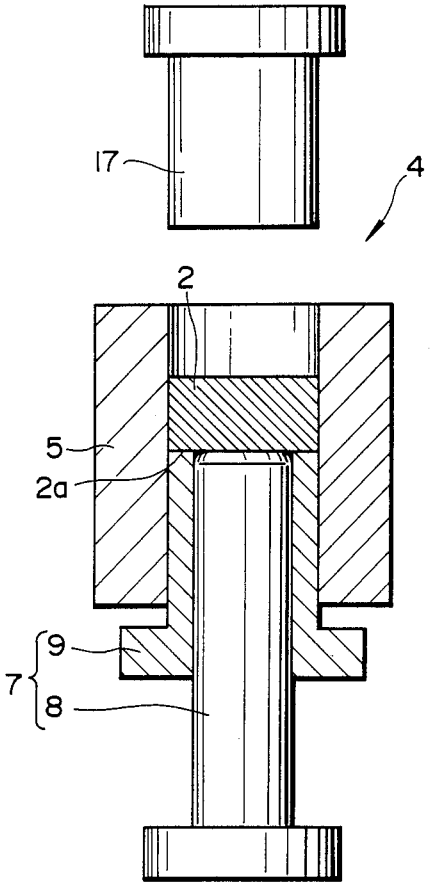
FIGS. 4(*a*) and 4(*b*) are sectional views illustrating the forming method of the anisotropic rare earth magnet material by forward extruding in order to perform said first aspect of this invention.
Figure 4B:
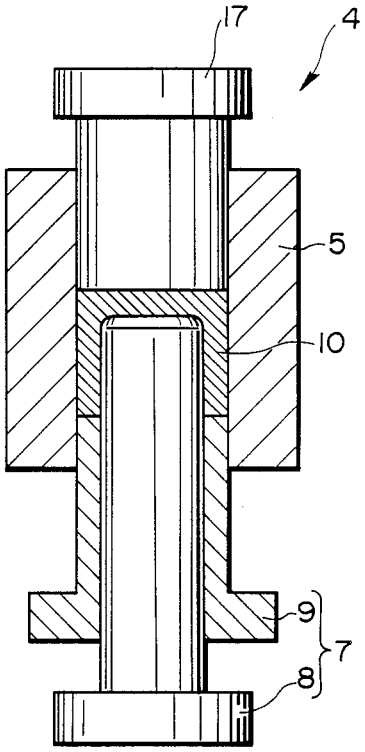

As shown in FIG. 4(*a*), the cylindrical compacted material 2 is set in the molding cavity of the mold 4 comprising the die 5, an upper punch 17, and a lower die which is the double action punch 7 having the core punch 8 and the sleeve punch 9, and the predetermined compressive stress is applied on the lower face 2*a* by said sleeve punch 8. By forcing down the upper punch 17 in this state, the compacted material 2 is formed into the sleeve-shaped magnet material 10 as shown in FIG. 4(*b*). Hereupon, said sleeve punch 8 is moved in the forward extruding direction of the upper punch 17, that is the downward direction in the figure corresponding to the deformation of the compacted material 2, and the predetermined compression stress is applied continuously on the compacted material 2. Thereby, it is possible to prevent the forming cracks on the inner and outer periphery of the sleeve-shaped magnet material 10.

Then in the forming of the sleeve-shaped magnet material 10 like this, it is necessary to perform plastic working of a reduction ratio fo area of 40 to 80%, preferably 55 to 65% in order to give the sufficient magnetic anisotropy in the radial direction. Therefore, the reduction ratio of area by extruding is sometimes too high at the case in which the solid-cylindrical compacted material 2 as shown in FIG. 1 and FIG. 4 is used in order to obtain the thin-sleeve shaped magnet material.

In such a case, it is preferable to use the hollow cylindrical compacted material 3 abtained by the manner as shown in FIG. 3. Namely, the hollow cylindrical compacted material 3 is molded through the manner shown in FIG. 3, said compacted material 3 is set in the molding cavity 4a formed by the die 5 and the lower punch 6, and by forcing down the sleeve punch 9, the predetermined compressive stress is applied on the upper face 3a of the compacted material 3 as shown in FIG. 5(*a*).

Figure 5A:
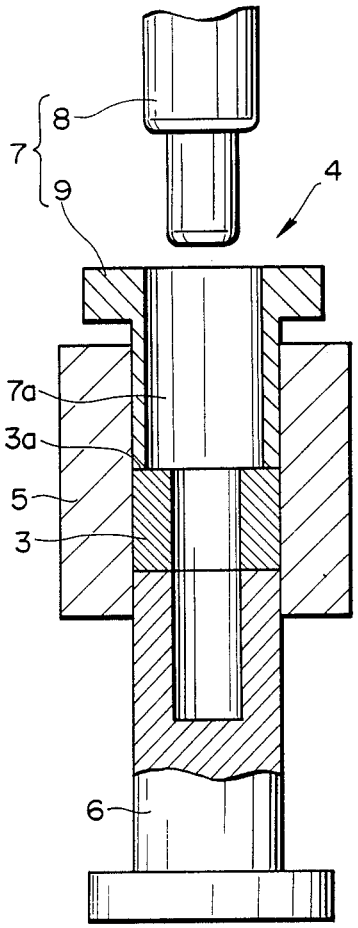
FIGS. 5(*a*) and 5(*b*) are sectional views illustrating the forming method of the anisotropic rare earth magnet material from the hollow cylindrical compacted material in order to perform said first aspect of this invention.
Figure 5B:
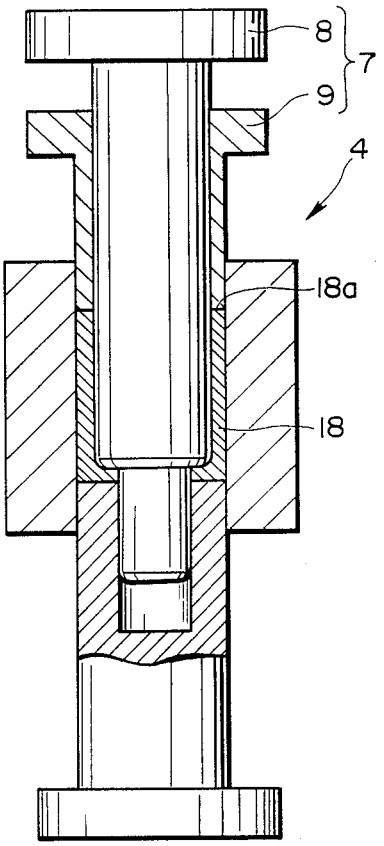

Nextly, by forcing down the core punch 8 as shown in FIG. 5(*b*), the compacted material 3 is formed into the sleeve-shaped magnet material 18 by backward extruding. At this time, it is possible to prevent the forming cracks because the compressive stress is applied on the upper face 3a (18a) by the sleeve punch 8 at all times.

In addition, the hollow cylindrical compacted material 3 may be formed into the sleeve-shaped magnet material similar to above by formed extruding.

In the method for producing the anisotropic rare earth magnet according to the second prefereed aspect of this invention, as described above, the solid or hollow compacted material having theoretical density ratio of not lower than 99% and magnetic isotropy is obtained by compressing uniformly the heated material which is the green compact molded by cold pressing or the powdered material of super-quenched magnet alloy at a temperature of 650°~950° C. using the double action punch of which core punch and sleeve punch work as in one united body in the first step. Said compacted material is formed continuously in the same mold, as the second step into the sleeve or ring-shaped anisotropic rare earth magnet material having a ring-shaped section by extruding using only the core punch of said double action punch without reheating said compacted material. Hereafter, said magnet material becomes into an anisotropic rare earth permanent magnet by giving magnetism further through proper means.

Additionally, in the second step, the sleeve punch of the double action punch may be backed from the end-face of the compacted material, however it is possible to prevent the occurrence of the forming cracks surely by keeping at a state in which the end-face of the compacted material is pressurized with predetermined relatively low presure.

And, it is preferable to perform these formings at a temperature between 650° C. and 950° C. in the vacuum of not more than 1 Torr or in the atomosphere of an inert gas similarly to the aforementioned aspect.

In this aspect, the solid or hollow compacted material with magnetic isotropy is formed using powdered material or the green compact molded with said powdered material by cold pressing, said compacted material is formed continuously into the sleeve or ring-shaped magnet material having the ring-shaped section by extruding. As extruding method in this case, backward extruding and forward extruding are both applicable.

In the past, this material deteriorates in the magnetic property owing to the growing of the grain size caused by heating for a long time because the compacted material with magnetic isotropy is molded by compressing the heated powdered material or the green compact molded from said powdered material in the first step, and said compacted material is reheated and extruded into the sleeve or ring-shaped magnet material having the ringshaped section and magnetic anisotropy using the different mold in the second step. Therefore, the method for producing the anisotropic rare earth magnet according to this aspect of this invention is so constructed that the sleeve or ring-shaped permanent magnet having the ringshaped section and magnetic anisotropy may be obtained with a set of mold through the single heat process by using the double action punch provided with the core punch and the sleeve punch. Furthermore, the method according to this aspect is so constructed as to prevent the occurrence of the forming cracks efficiently by applying continuously the predetermined compressive stress on the free surface of the end-face of the compacted material with the sleeve punch of the double action punch in the second step.

The method for producing the anisotropic rare earth magnet according to this aspect will be explained below on basis of FIG. 6.

First of all, the green compact cold-pressed by the usual powder molding procedure is prepared through the steps of making a thin strip of the base alloy by cooling the molton base alloy of the rare earth magnet super-rapidly and molding the powder of said thin strip of the base alloy. The density of said green compact equals 70~80% of the theoretical density, and should equal 80% approximately in case of molding it by common molding procedure. Said green compact is preheated at a temperature between 650° C. and 900° C., preferably between 700° C. and 800° C. in advance by proper heating means. Nextly, said green compact 19 is set in the molding cavity 4a of the mold 4 provided with the die 5, the lower punch 6, and the double action punch 7 having the core punch 8 and the sleeve punch 9 as shown FIG. 6(*a*). In this time, the mold 4 is also preheated at a temperature between 600° C. and 900° C., preferably between 700° C. and 800° C. by proper heating means. A green compact 19 may be heated by the heat transmission from the mold 4 by heating only the mold 4 when the green compact 19 is small. And the green compact 19 can be sometimes molded by heating only the green compact 19 without heating the mold 4 when the green compact 19 is large. In addition, the powdered material may be set in the molding cavity 4a of the mold 4 in stead of the green compact 19. And it in desirable to house these apparatus wholly in a sealing chamber which is kept at a vacuum of pressure of not more than 1 Torr or filled with an inert gas such as argon gas according to demand.

Figure 6A:
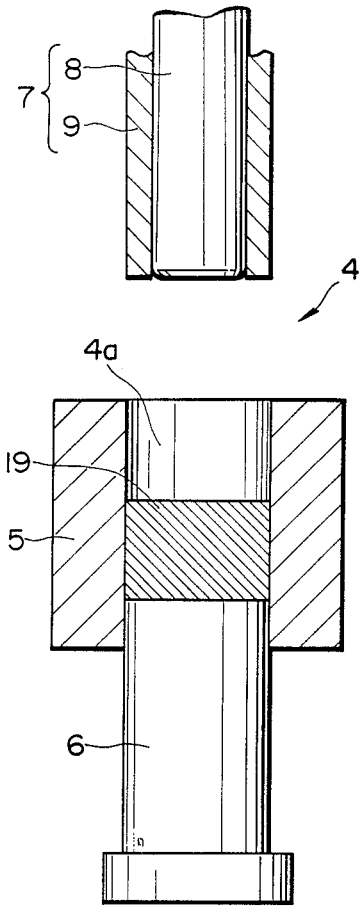
FIGS. 6(*a*), 6(*b*) and 6(*c*) are sectional views illustrating the forming method of the anisotropic rare earth magnet material through the cylindrical compacted material by backward extruding in order to perform the method for producing the anisotropic rare earth magnet according to the second preferred aspect of this invention.
Figure 6B:
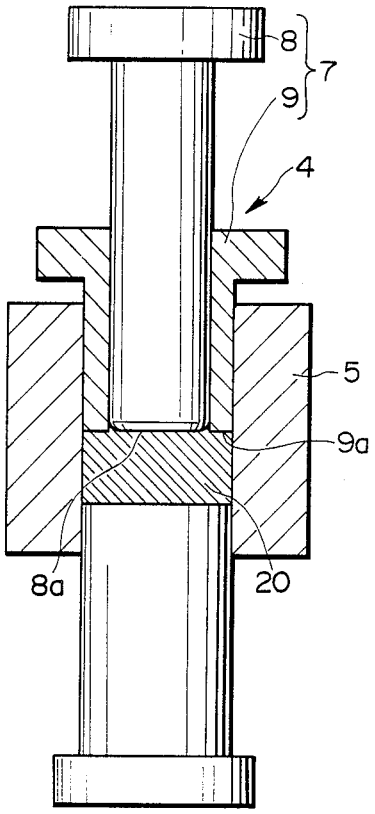
Figure 6C:
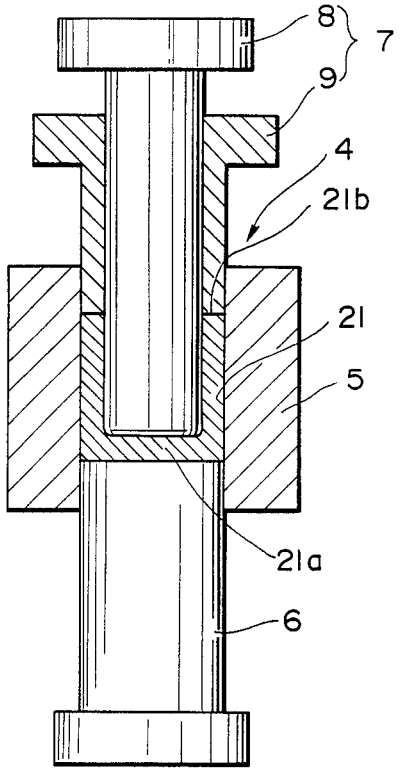

Subsequently, by forcing down the double action punch 7 so that the end-face 8a of the core punch 8 may coincide with the end-face 9a of the sleeve punch 9 of the double action punch 7 as one body and compressing the green compact 19 uniformly, a compacted material 20 is obtained as shown in FIG. 6(*b*). The compressive stress of 0.5~2.0 ton/cm$^2$, preterably 1.0~1.5 ton/cm$^2$ is suitable to be applied at this time. Thereby, the compacted material (cylindrical isotropic magnet material) 20 of which theoretical density ratio is not lower than 99% is obtained.

Then, by forcing down only the core punch 8 of the double action punch 7 as shown FIG. 6(*c*), the compacted material 20 shown in FIG. 6(*b*) is formed into a sleeve-shaped anisotropic rare earth magnet material 21 having the ringshaped section by backward extruding. In this time, the extruding pressure is suitable to be 2~5 ton/cm$^2$, preferable 3~4 ton/cm$^2$ at the pressing face of the punch.

Additionally, there is the possibility of the occurrence of the forming cracks on the inner periphery of the anisotropic magnet material 21 at the time of extruding, but it is possible to prevent the forming cracks securely by applying the compressive stress on the upper surface 21b in the direction of the arrow in FIG. 6(*c*) with the sleeve punch 9. It is suitable to apply the pressure of 0.2~1.0 ton/cm$^2$, preferably 0.4~0.6 ton/cm$^2$ as the compressive stress in this case.

By elevating the lower punch 6 after finishing the extruding, the sleeve-shaped anisotropic rare earth magnet material 21 is knocked out of the mold 4 and cut off at the bottom part 21*a* thereof separately, and subsequently an anisotropic rare earth magnet is obtained by magnetizing the sleeve-shaped anisotropic rare earth magnet material 21 in the radial direction.

Also in this aspect, the forward extruding may be available in addition to said backward extruding similarly to the aforementioned aspect. The forming according to the forward extruding will be explained below on basis of FIG. 7.

Figure 7A:
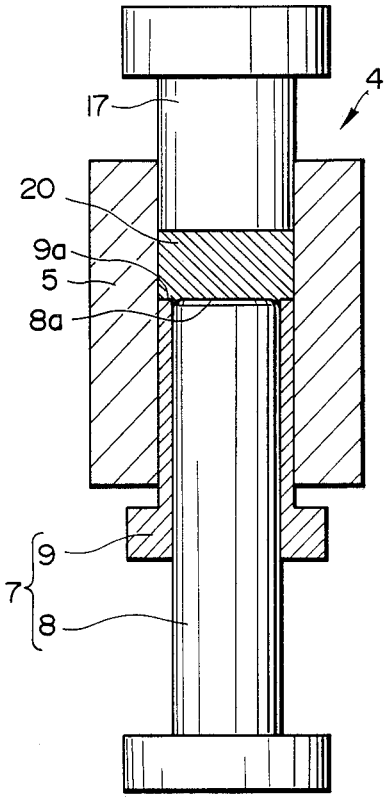
FIGS. 7(*a*) and 7(*b*) are sectional views illustrating the forming method of the anisotrotic rare earth magnet material by forward extruding in order to perform said second aspect of this invention.
Figure 7B:
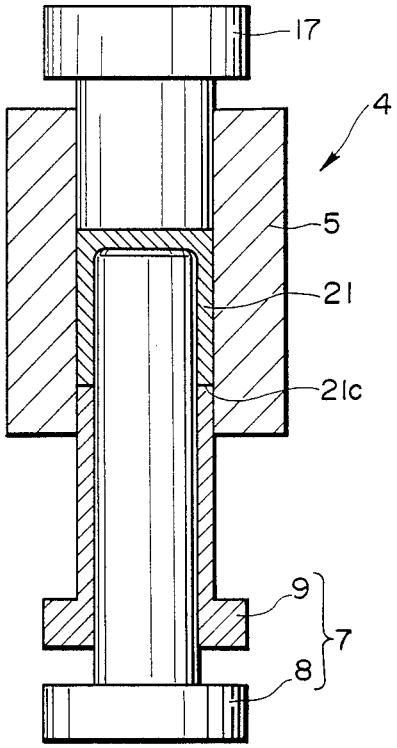

The mold 4 shown in FIG. 7 comprises the die 5, an upper punch 17 and a lower die which is the double action punch having the core punch 8 and the sleeve punch 9 fitted on said core punch 8 slidably. At the first, the green compact is set in the molding cavity formed by the die 5 and the double action punch 7 in state of making the upper face 8*a* of the core punch 8 and the upper face 9*a* of the sleeve punch 9 into the same height as shown in FIG. 7(*a*), and by compressing the green compact using the upper punch 17, the compacted material 20 of which theoretical density ratio is not lower than 99% is obtained. Subsequently, the upper punch 17 is forced down at the state of fixing the core punch 8 as shown in FIG. 7(*b*), the compacted material 20 is formed into the sleeve-shaped anisotropic rare earth magnet matreial 21 by the forward extruding. In this case, it is possible to prevent the occurrence of the forming cracks securely by applying the predetermined compression stress on the lower face 21*c* of the anisotropic rare earth magnet material 21 using the sleeve punch 9 of the double action punch 7.

Figure 8A:
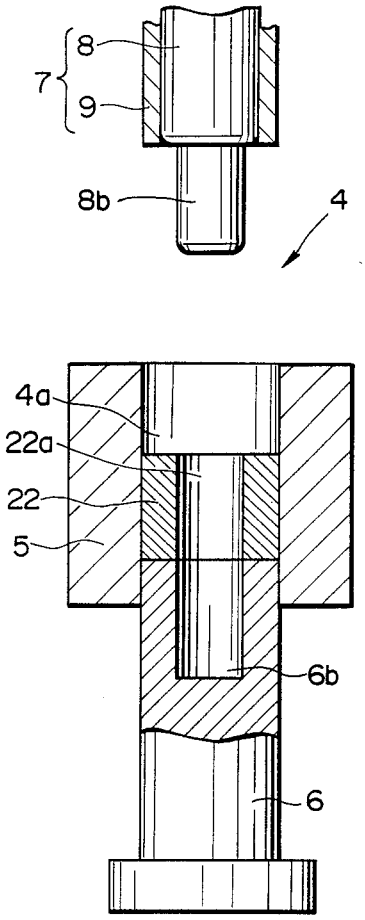
FIGS. 8(*a*), 8(*b*) and 8(*c*) are sectional views illustrating the forming method of the anisotropic rare earth magnet material through the hollow cylindrical compacted material in order to perform said second aspect of this invention.
Figure 8B:
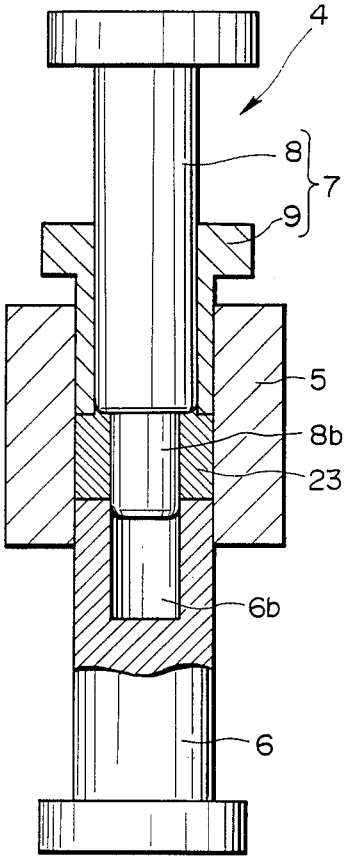
Figure 8C:
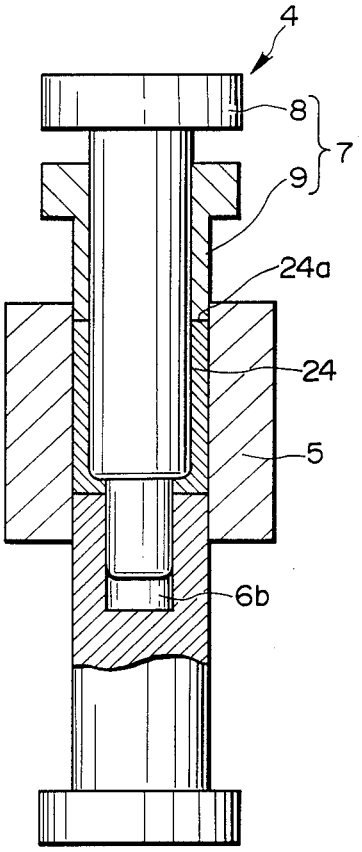

As also explained in the aforementioned aspect, in case the reduction ratio of area by extruding becomes too high by using the solid-cylindrical compacted material 19, it is suitable to use a hollow cylindrical green compact 22 as shown in FIG. 8. Namely, the hollow cylindrical green compact 22 molded by cold pressing is set in the molding cavity 4*a* of the mold 4 comprising the die 5, the double action punch 7 having the core punch 8 and the sleeve punch 9, and the lower punch 6 as shown in FIG. 8(*a*), and by forcing down the core punch 8 and the sleeve punch 9 of the double action punch 7 at the same time, a compacted material 23 which is an isotropic magnet material having the theoretical density ratio of not lower than 99% is obtained as shown in FIG. 8(*b*). In this time, the core punch 8 provided with a slender part 8*b* to be inserted in a hollow part 22*a* of the hollow cylindrical green compact 22 is used, and the core punch 8 is in the state of inserting the slender part 8*b* into the compacted material 23 as shown in FIG. 8(*b*). And the lower punch 6 is provided with a hollow part 6*b* to receive the slender part 8*b* of said core punch 8. Next, forcing down only the core punch 8 of the double action punch 7 as shown in FIG. 8(*c*), the compacted material 23 is formed into the thin sleeve-shaped anisotropic rare earth magnet material 24 by extruding. Hereupon, it is possible to prevent the occurrence of the forming cracks securely by applying the predetermined compressive stress on the upper face 24*b* of the anisotropic rare earth magnet material 24 using the sleeve punch 9, but it is possible to form without applying said compressive stress.

The method for producign the anisotropic rare earth magnet according to this aspect of this invention is so constructed that the sleeve or ring-shaped anisotropic rare earth magnet having the excellent magnetic property and the ring-shaped section is produced by the single heat process in the super-quenched anisotropic magnet which is magnetized after giving the magnetic anisotropy by plastic deformation without forming in a magnetic field.

EXAMPLE 1

At first, by cooling magnet alloy having the composition of $Nd_{13}Fe_{82.7}B_{4.3}$ super-rapidly, a thin strip of 20 μm in thickness was obtained, and flaky powder for size of about 200 μm was obtained by grainding the thin strip.

By compressing said powder under molding conditions in which pressure and temperature were 1 ton/cm$^2$ and 700° C. in an atomosphere of argon using a mold of the type shown in FIG. 2, a cylindrical compacted material 2 having a diameter of 30 mm and a height of 19 mm was obtained. The theoretical density ratio of this compacted material 2 was 99.6%.

Figure 9:
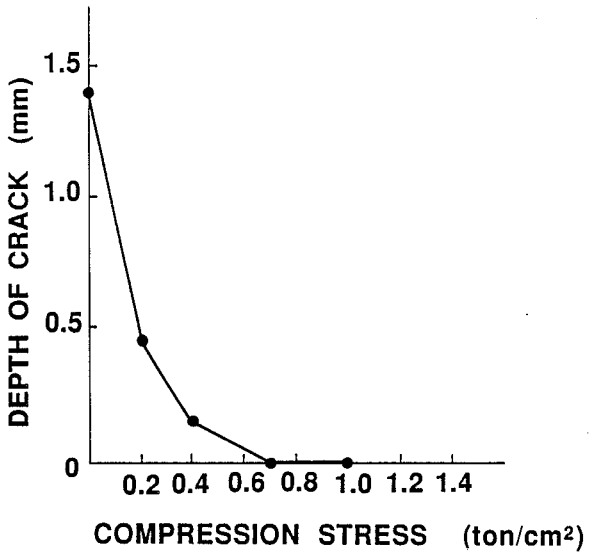
FIG. 9 is a graph showing the relationship between the compression stress and the depth of the forming crack obtained as the experimental results of Example 1.

Said compacted material 2 was extruded backwardly into a sleeve-shaped magnet material 10 with the die 5, the lower punch 6 and the core punch 8 using the mold 4 shown in FIG. 1 while the compression stresses of different magnitude were applied on the free surface of the compacted material 2 using the sleeve punch 9. And the relation between the depth of the forming crack on the inner periphery 10*a* and the compression stress applied on the upper face 2*a*(10*c*) was investigated. The results are shown in FIG. 9. In this case, the sleeve-shaped anisotropic magnet material 10 had an outer diameter of 30 mm and an inner diameter of 23 mm, and a reduction ratio of area by extruding was 59%. Furthermore, the forming temperature was 750° C., and these were treated in an atomosphere of argon.

As is obvious from the figure, the depth of the forming crack decreases remarkably by applying the compression stress.

In general, at the case of using said sleeve-shaped magnet material 10 as a magnet, the inner and outer peripheries of said magnet material 10 are cut off, and shallow cracks are removed in this time. Therefore, the cracks having a depth of 0.5 mm, preferably 0.2 mm is not an obstacle in practical application.

Subsequently, the sleeve-shaped anisotropic magnet material 10 was magnetized in the radial direction after cutting off the bottom part 10*d* thereof, and the maximum magnetic energy product (in the radial direction) was measured. As a result, the measured value of 34 MGOe was obtained.

EXAMPLE 2

By compressing the same flaky powder as described above under molding conditions in which pressure and temperature were 1.3 ton/cm$^2$ and 750° C. in an atomosphere of argon using a mold of the type shown in FIG. 3, a hollow cylindrical compacted material 3 having an outer diameter of 30 mm, an inner diameter of 15 mm and a height of 20 mm was obtained. The theoretical density ratio of this compacted material 3 was 99.3%.

The whole surface of said compacted material 3 was plated with nickel of 50 μm thick as an antioxidizing film.

Said compacted material 3 coated with the antioxidizing film was heated at a temperature of 800° C. in the air using a high-frequency heating apparatus, and formed by backward extruding in the air using the mold 4 shown in FIG. 5 heated in advance at a temperature of 700° C. In this case, the inner diameter of the sleeve-shaped anisotropic magnet material 18 was 30 mm, and the reduction ratio of area by extruding is varied between 30% and 80% by changing the inner diameter. And the relationship between the depth of the forming cracks and the reduction ratio of area by extruding was investigated concerning the case of applying a compression stress of 0.8 ton/cm$^2$ on the upper face 3*a* (18*a*) of the compacted material 3 by the sleeve punch 9 and the case in which the compression is not applied. In addition, the pressure . the core punch 8 was 3 ton/cm$^2$.

Figure 10:
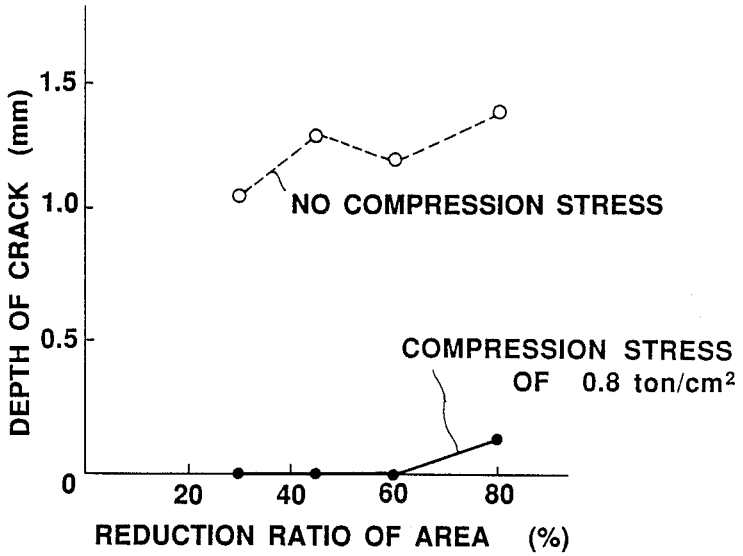
FIG. 10 and FIG. 11 are graphs showing the relationship between the reduction ratio of area and the depth of the forming crack and the relationship between the reduction ratio of area and the maximum magnetic energy product obtained as the experimental results of Example 2, respectively.

The results are shown in FIG. 10. From this figure, it is apparent that applying the compression stress on the upper face 3*a* (18*a*) is effective to prevent the forming cracks remarkably.

Figure 11:
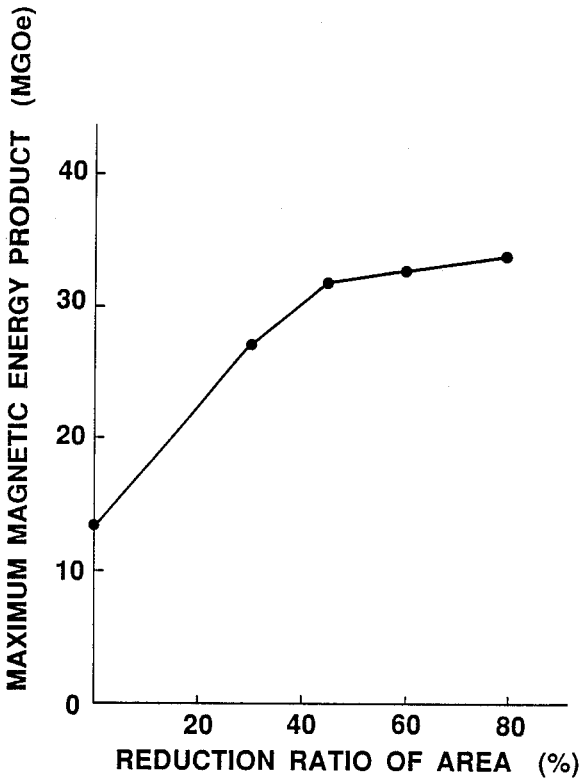
Figure 12A:
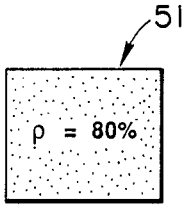
FIG.12(a) (PRIOR ART)
FIGS. 12(*a*), 12(*b*) and 12(*c*) are sectional views illustrating the conventional method for producting the anisotropic rare earth magnet.
Figure 12B:
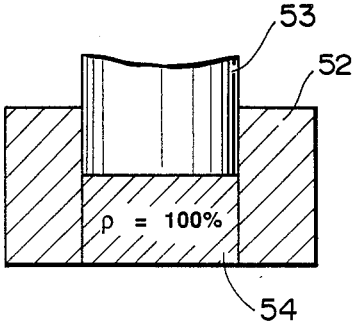
FIG.12(b) (PRIOR ART)
Figure 12C:
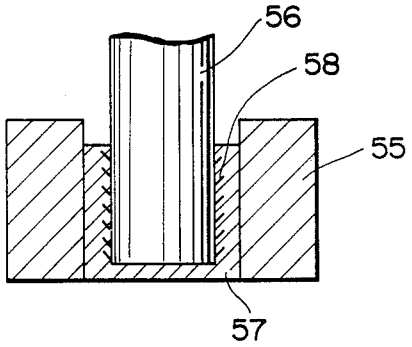
FIG.12(c) (PRIOR ART)

Furthermore, said sleeve-shaped anisotropic magnet material 18 was magnetized in the radial direction after cutting off the bottom part and finishing the inner and outer peripheries thereof by cutting. And the results of measuring the maximum magnetic energy product in the radial direction are shown in FIG. 11.

According to this figure, the magnet having an excellent magnetic property more than 30 MGOe is obtained when the reduction ratio of area by extruding exceeds 40%.

EXAMPLE 3

Flaky powder for size of about 200 μm was obtained by grainding a thin strip of 20 μm in thickness obtained by cooling molton base alloy of rare earth magnet having the composition of $Nd_{13.5}Fe_{80.5}B_{6.0}$ super-rapidly. Nextly, a cylindrical green compact having an outer diameter of 29.5 mm and a height of 25 mm using the usual powder molding press after mixing uniformly 0.5% of lithium stearate into said powder by weight percentage. Successively, said green compact was degreased during a time of 30 min, at a temperature of 450° C. in a vacuum of $10^{-2}$ Torr using the usual vacuum degassing apparatus, and do the lithium stearate was removed by vaporization. The result of measuring the density of the green compact was 77% in theoretical density ratio.

Subsequently, the green compact attained to 750° C. by heating during a time of 2 min in an atomosphere of argon after applying graphite powder on the surface thereof as a lubricant and drying it, and was set immediately in the molding cavity 4*a* of the mold 4 shown in FIG. 6 having the die 5 of 30 mm inner diameter. In this case, the mold 4 was preheated at 750° C. in advance. And the core punch 8 and the sleeve punch 9 were first forced down at the same time in an atomosphere of argon, and a compacted material 20 was obtained by compressing uniformly at a pressure of 1 ton/cm$^2$. In this time, said compacted material 20 was taken out of the mold 4 in order to measure the dimensions and the density thereof for reference after cooling (it is not necessary to take out of the mold 4 in the manufacturing process for the purpose of only manufacturing). As the measured results, the compacted material 20 had a diameter of 30.1 mm, a height of 18.5 mm and a theoretical density ratio of 99.6%.

Nextly, the only core punch 8 having a diameter of 24 mm was forced down continuously as shown in FIG. 6(*c*) after obtaining the compacted material 20 compressed uniformly through the same molding process as described above, and a sleeve-shaped anisotropic rare earth magnet material 21 was obtained. The pressure applied by the core punch 8 in this case was 4 ton/cm$^2$, and the pressure of 0.6 ton/cm$^2$ was applied to the sleeve punch 9 so as to follow the change of the height of the free surface 21*b* of the anisotropic rare earth magnet material 21.

The anisotropic rare earth magnet material 21 was taken out of the argon chamber and gauged after cooling down, as the results the magnet material 21 was 30.1 mm in outer diameter, 24.1 mm in inner diameter, 45 mm in height and 3.5 mm in bottom thickness, and any forming crack was not recognized on the inner and outer peripheries of it.

And, the sleeve-shaped anisotropic rare earth magnet material 21 was made into an anisotropic rare earth magnet by magnetizing in the radial direction after cutting off the bottom part 21*a* thereof. As a result of measuring its maximum magnetic energy product in the radial direction of said anisotropic rare earth magnet, the measured value of 31 MGOe was obtained.

EXAMPLE 4

One hundred g of same flaky powder as used in Example 3 was weighted out, and the powder was set without heating in the molding cavity 4*a* of the mold 4 shown in FIG. 6 preheated at 800° C. in an atomosphere of argon. The inner diameter of the die 5 of the mold 4 was 30 mm.

Subsequently, the core punch 8 and the sleeve punch 9 were forced down at the same time as shown in FIG. 6(*b*), said powder was heated by heat transmission from the mold 4, and the powder was compressed at a pressure of 1 ton/cm$^2$ and maintained for 2 minutes as it was in order to increase the density.

And, by forcing down the only core punch 8 (of which diameter is 24 mm), the sleeve-shaped anisotropic rare earth material 21 was obtained by backward extruding. In this case, the pressure of the core punch 8 was 3.5 ton/cm$^2$, and the sleeve punch 9 was backed so as not to apply the compression stress on the free surface.

As the results of measuring the dimensions of said anisotropic rare earth magnet material 21 taken out of the argon chamber after cooling down, said magnet material 21 was 30.1 mm in outer diameter, 24.1 mm in inner diameter, 45.5 mm in height and 3.4 mm in bottom thickness. However, the forming cracks of about 1.2 mm in depth were recognized on the inner periphery of the magnet material 21.

Nextly, the sleeve-shaped anisotropic rare earth magnet material 21 was cut off at the bottom part 21*a*, and the forming cracks were removed by grinding the inner peripheral part of said magnet material 21. Thereby, the inner diameter became into 26.5 mm. And by magnetizing said magnet material 21 in the radial direction, an anisotropic rare earth magnet was obtained. The result of measuring its maximum magnetic energy product in the radial direction of said anisotropic rare earth magnet was 28 MGOe.

As mentioned above, the method for producing an anisotropic rare earth magnet according to the first preferred aspect of this invention is characterized by extruding a compacted material with magnetic isotorpy into a required from having a ringshaped section at the same time of applying compression stress on a free surface of said compacted material. Therefore, an excellent effect can be obtained since it is possible to produce an anisotropic rare earth magnet having an excellent magnetic property without occurrence of the forming cracks. And the method for producing an anisotropic rare earth magnet according to the second preferred aspect of this invention in characterized by producing the anisotropic rare earth magnet having the ring-shaped section by single heat process through the steps of making a thin strip by cooling super-rapidly molton rare earth magnet alloy, molding a green compact from the powder of said thin strip of rare earth magnet alloy by cold pressing, compressing uniformly the green compact (or the powder directly without using the green compact) heated at a temperature between 650° C. and 900° C. into a compacted material having theoretical density ratio of not lower than 99% using a double action punch provided with a core punch and a sleeve punch, and in successively extruding the compacted meterial into a required from having a ring-shaped section by using the core punch subsequent to backing the sleeve punch of said double action punch. Therefore, in the super-quenched anisotropic magnet which is magnetized after giving the magnetic anisotropy by plastic deformation without forming in a magnetic field, it is possible to produce economically the anisotropic rare earth magnet having the excellent magnetic property and the ring-shaped section because the mold can be used in common for forming the compacted material having the theoretical density ratio of not lower than 99% and for extruding said compacted material into the anisotropic magnet material, and the grain growth caused by heating for a long time is solved by the single heat process.

What is claimed is:

1. A method for producing an anisotropic rare earth magnet from a compacted material with magnetic isotropy, which is characterized by extruding the compacted material into a required form having a ring-shaped section at the same time of applying compressive stress on a free surface of said compacted material.

2. A method for producing an anisotropic rare earth magnet as claimed in claim 1, wherein the extruding is carried out at a temperature between 650° C. and 900° C. in a vacuum of not more than 1 Torr or in an atomosphere of an inert gas.

3. A method for producing an anisotropic rare earth magnet as claimed in claim 1, wherein the extruding is carried out at a temperature between 650° C. and 900° C. in the air subsequent to forming an non-oxidizing film on the surface of said compacted material.

4. A method for producing an anisotropic rare earth magnet by a single heat process, which comprises making a thin flake by cooling super-rapidly molton rare earth magnet alloy, molding a green compact from the powder of said thin flake of rare earth magnet alloy by cold pressing, compressing uniformly the green compact heated at a temperature between 650° C. and 900° C. into a compacted material having theoretical density ratio of not lower than 99% using a double action punch provided with a core punch and a sleeve punch, and in successively extruding the compacted material into a required form having a ring-shaped section by using the core punch subsequent to backing the sleeve punch of said double action punch.

5. A method for producing an anisotropic rare earth magnet as claimed in claim 4, wherein said compacted material is molded directly from the powder of said rare earth magnet alloy by compressing uniformly at a temperature between 650° C. and 900° C. using said double action punch without using the green compact molded by cold pressing.

6. A method for producing an anisotropic rare earth magnet as claimed in claim 4, wherein the extruding is carried out by the core punch at the state of applying predetermined compressive stress on a free surface of said compacted material by the sleeve punch of said double action punch without backing said sleeve punch.

7. A method for producing an anisotropic rare earth magnet as claimed in claim 5, wherein the extruding is carried out by the core punch at the state of applying predetermined compressive stress on a free surface of said compacted material by the sleeve punch of said double action punch without backing said sleeve punch.

8. A method for producing an anisotropic rare earth magnet as claimed in claim 4, wherein the compressing and the extruding are carried out in a vacuum of not more than 1 Torr or in atomosphere of an inert gas.

9. A method for producing an anisotropic rare earth magnet as claimed in claim 5, wherein the compressing and the extruding are carried out in a vacuum of not more than 1 Torr or in atomosphere of an inert gas.

10. A method for producing an anisotropic rare earth magnet as claimed in claim 6, wherein the compressing and the extruding are carried out in a vacuum of not more than 1 Torr or in atomosphere of an inert gas.

11. A method for producing an anisotropic rare earth magnet as claimed in claim 7, wherein the compressing and the extruding are carried out in a vacuum of not more than 1 Torr or in atomosphere of an inert gas.

12. A method for producing an anisotropic rare earth magnet as claimed in claim 4, wherein said green compact is molded from the powder mixed with a lubricant of not more than 2% in weight percentage in order to increase the green density of said green compact.

13. A method for producing an anisotropic rare earth magnet as claimed in claim 6, wherein said green compact is molded from the powder mixed with a lubricant of not more than 2% in weight percentage in order to increase the green density of said green compact.

14. A method for producing an anisotropic rare earth magnet as claimed in claim 8, wherein said green compact is molded from the powder mixed with a lubricant of not more than 2% in weight percentage in order to increase the green density of said green compact.

15. A method for producing an anisotropic rare earth magnet as claimed in claim 10, wherein said green compact is molded from the powder mixed with a lubricant of not more than 2% in weight percentage in order to increase the green density of said green compact.

16. A method for producing an anisotropic rare earth magnet as claimed in claim 12, wherein said lubricant is one or more of stearates.

17. A method for producing an anisotropic rare earth magnet as claimed in claim 13, wherein said lubricant is one or more of stearates.

18. A method for producing an anisotropic rare earth magnet as claimed in claim 14, wherein said lubricant is one or more of stearates.

19. A method for producing an anisotropic rare earth magnet as claimed in claim 15, wherein said lubricant is one or more of stearates.

20. An apparatus for producing an anisotropic rare earth magnet provided with a double action punch having a core punch and a sleeve punch.

* * * * *